US005722183A

United States Patent [19]

Orloff et al.

[11] Patent Number: 5,722,183

[45] Date of Patent: Mar. 3, 1998

[54] APPARATUS FOR DRYING A PAPER WEB AT ELEVATED AMBIENT PRESSURES

[75] Inventors: David I. Orloff; Timothy F. Patterson, both of Atlanta, Ga.; Andrew M. Krause, Monroe, La.

[73] Assignee: Institute of Paper Science and Technology, Inc., Atlanta, Ga.

[21] Appl. No.: 674,594

[22] Filed: Jun. 26, 1996

Related U.S. Application Data

[62] Division of Ser. No. 440,539, May 12, 1995, Pat. No. 5,598,642.

[51] Int. Cl.[6] ..... F26B 21/06

[52] U.S. Cl. ..... 34/558; 34/71; 34/145; 34/146

[58] Field of Search ..... 34/558, 71, 143, 34/144, 145, 146, 123; 162/359.1, 358.1

[56] References Cited

U.S. PATENT DOCUMENTS

| | | | |
|---|---|---|---|
| 3,938,261 | 2/1976 | Anderson | 34/114 |
| 3,981,084 | 9/1976 | Sobota | 34/123 |
| 4,017,980 | 4/1977 | Keinguenther | 34/145 X |
| 4,556,450 | 12/1985 | Chuang et al. | 34/123 X |
| 4,729,175 | 3/1988 | Beard et al. | 34/146 X |
| 4,947,559 | 8/1990 | Basler et al. | 34/145 X |
| 5,101,574 | 4/1992 | Orloff et al. | 34/18 |
| 5,327,661 | 7/1994 | Orloff | 34/388 |
| 5,385,644 | 1/1995 | Hannus et al. | 34/123 X |
| 5,404,654 | 4/1995 | Babinsky et al. | 34/122 |
| 5,439,559 | 8/1995 | Crouse | 162/358.5 |

*Primary Examiner*—Henry A. Bennett
*Assistant Examiner*—Steve Gravini
*Attorney, Agent, or Firm*—Fitch, Even, Tabin & Flannery

[57] ABSTRACT

A method and apparatus for drying a fiber web is provided by pressing the web, preferably by impulse drying and then introducing the web into a gas pressurized zone followed by reducing the pressure in the zone, the reduction preferably being effected with cooling of the fiber web.

4 Claims, 6 Drawing Sheets

12
13
16
24
14
15
11
23
22
26
25
21
20
19
18
28
27
17

204 g/m$^2$
25 m$^2$/g specific surface
65% moisture

| PLATEN TEMPERATURE | CRITICAL PRESSURE (GAGE) |
|---|---|
| 140 C | LESS THAN 0.03 MPa |
| 150 C | LESS THAN 0.03 MPa |
| 175 C | 0.03 MPa |
| 200 C | 0.08 MPa |
| 260 C | 0.28 MPa |
| 330 C | 0.45 MPa |

| BASIS WEIGHT lb/1000 ft $^2$ | MOISTURE % | FREENESS ml, CSF | SPECIFIC SURFACE $m^2/g$ | CRITICAL PRESSURE AT 250° C MPa GAUGE |
|---|---|---|---|---|
| 90 | 50 | 700 | 3 | LESS THAN 0.10 |
| 90 | 75 | 700 | 3 | 0.13 |
| 90 | 50 | 400 | 25 | 0.42 |
| 90 | 75 | 400 | 25 | 0.69 |
| 26 | 50 | 700 | 3 | 0.00 |
| 26 | 75 | 700 | 3 | 0.00 |
| 26 | 50 | 400 | 25 | 0.17 |
| 26 | 75 | 400 | 25 | 0.10 |

APPARATUS FOR DRYING A PAPER WEB AT ELEVATED AMBIENT PRESSURES

This is a division of application Ser. No. 08/440,539, filed May 12, 1995 now U.S. Pat. No. 5,598,642.

FIELD OF THE INVENTION

The present invention relates generally to a method and apparatus for drying a wet fiber web using a pressing operation in which one surface of the press is heated to a high temperature. The apparatus provides the capability to expose the web to ambient pressures above atmospheric and increasing cooling rates when the press load is released. The press may be a linear motion press, a roll press, or a shoe press. The web may be a single sheet or a continuous web. More particularly, the invention relates to impulse drying of a wet paper web.

BACKGROUND OF THE INVENTION

Impulse drying occurs when a wet paper web, carried on a water absorbing felt, passes through the press nip of a pair of rolls, or a roll and shoe, in which a roll is heated to a high temperature. Impulse drying may also be accomplished using a linear press with flat platens, in this case one platen is heated and the other may be at ambient temperature. It is projected that wide commercialization of impulse drying would result in a large industry wide energy savings.

In addition to the impact on energy consumption, impulse drying also has an impact on paper sheet structure and properties. Surface fiber conformability and interfiber bonding are enhanced by transient contact with the hot pressing surface. Impulse drying produces a distinctive density profile through the sheet that is characterized by a dense outer layer. This translates into improved physical properties for many grades of paper. The persistent problem with the use of impulse drying is that as the press load is released, the pressure exerted on the heated fluid inside the web is reduced and flash evaporation can occur inside the web. The result is that the web delaminates. This is particularly a problem with heavy weight grades of paper. It has been a major constraint in the commercialization of impulse drying.

It has been reported, Crouse, et al. "Delamination: A Stumbling Block to Implementation of Impulse Drying Technology for Liner Board", TAPPI Engineering Conference, Atlanta, Ga., Sept. 1989, that various degrees of delamination were experienced with liner board dried at press roll surface temperatures above 150° C. (300° F.). When delamination was avoided by operating at temperatures below 150° C. (300° F.), water removal efficiencies were not significantly different than those obtained by conventional pressing. It was concluded in this paper that to realize the potential of impulse drying it would be necessary to alleviate delamination.

In laboratory scale simulations, Laverly, H. P., "High Intensity Drying Process—impulse Drying Report Three" DOE/CE/40738-T3, February, 1988, it was found that increased pulp refining encouraged delamination and it was postulated that thick or highly refined sheets exhibit greater resistance to the flow of vapor than thin or unrefined paper webs. Thick and refined paper webs have a high specific surface and therefore a high flow resistance. When the press load is released, high vapor pressures are produced internal to the web because the vapor cannot readily escape the web. If the pressure is high enough, the web structure fails and the web delaminates. Reducing the temperature of the press surface eliminates delamination, but also reduces water removal to the point that the impulse drying process is no more efficient than standard double felted pressing.

Orloff, D. I., in "Impulse Drying Control of Delamination" and U.S. Pat. No. 5,101,574 shows that reducing the thermal diffusivity of the heated press surface reduces the probability that delamination will occur. Thermal diffusivity is the $K/\rho C_v$ where K is the thermal conductivity, $\rho$ is the density and $C_v$ is the specific heat. The magnitude of this quantity determines the rate at which a body with a non-uniform temperature approaches equilibrium. The units of thermal diffusivity, after cancelling like terms are meter$^2$ per second ($m^2/s$).

It is explicitly stated by Orloff that the press surface must be impermeable to steam. If a porous material is used to reduce the thermal diffusivity of the press surface, the characteristic density profile of impulse drying is not produced. Orloff shows that a non-permeable, low thermal diffusivity press surface allows higher press surface temperatures to be used for some furnishes, as compared to a high thermal diffusivity surface. A typical high thermal diffusivity surface is steel. A low thermal diffusivity surface can be produced using ceramics, polymers, inorganic plastics, composite materials and cermets. At the higher press surface temperatures made possible by a low thermal diffusivity surface, the water removal efficiency of impulse drying exceeds that of double felted pressing. A low thermal diffusivity press surface will produce web delamination if the heated press surface is at too high a temperature.

It is the principal object of the present invention to provide a method and apparatus for heated surface pressing and impulse drying which inhibits web delamination at heated press surface temperatures ranging from the ambient boiling temperature of the internal web liquid to temperatures in excess of the critical point temperature of the internal web liquid. The method and apparatus are effective at inhibiting web delamination regardless of press surface thermal diffusivity, web internal structure, web basis weight, or web internal liquid.

SUMMARY OF THE INVENTION

Figure 1:
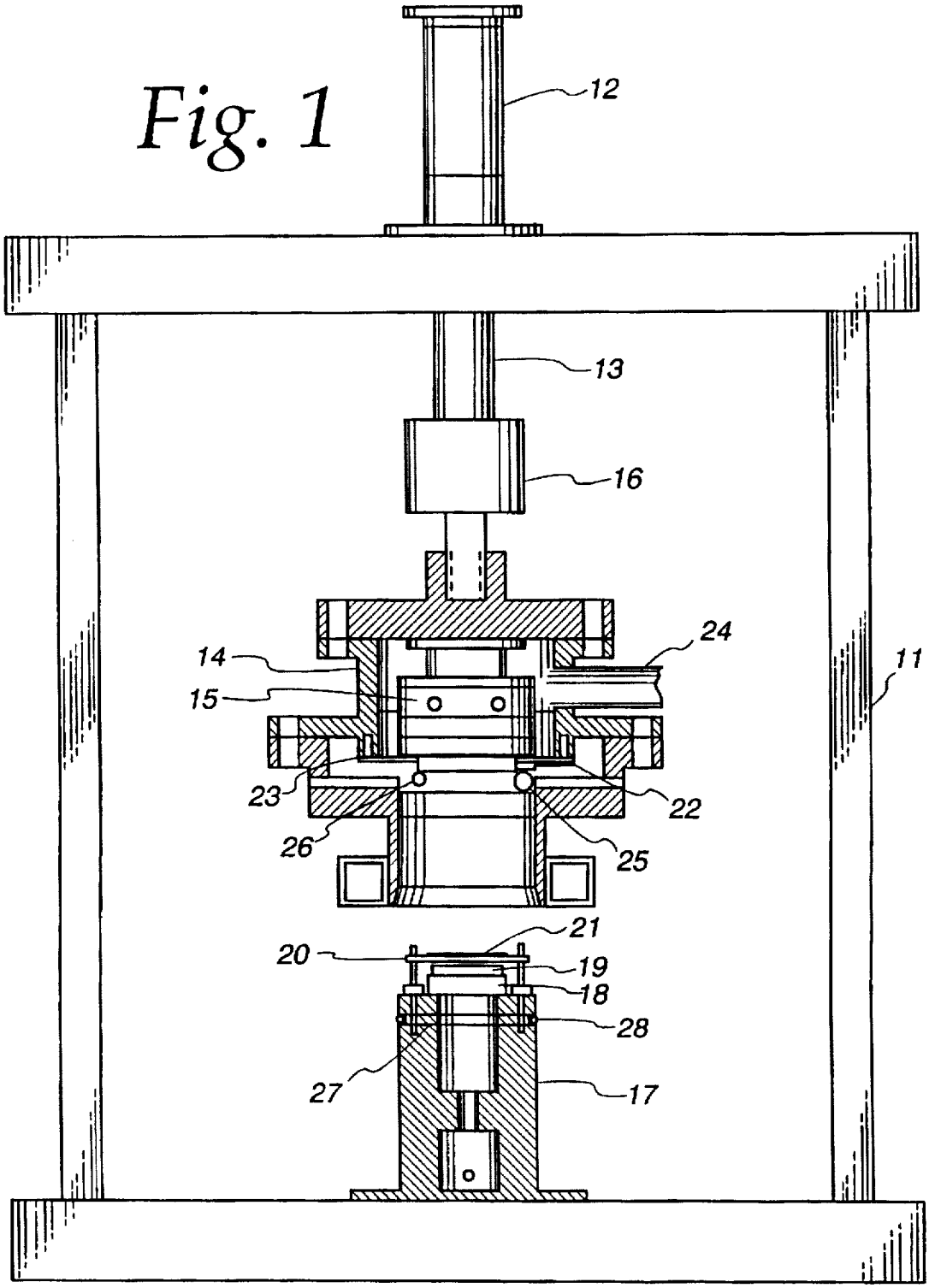
FIG. 1 is a schematic drawing, in side view, of an electrohydraulic press, pressure cylinder and pressure piston that is designed to perform heated press surface pressing at elevated pressures.

The present invention is directed generally to a method and apparatus for drying a wet fiber web or sheet using a heated surface press and a particular application is impulse drying. The method can be applied to either a linear motion press, to a roll nip press, to a shoe press, or a wide nip press. The method provides a region of elevated gas pressure and/or an increased cooling rate which coincides with the region the sheet or web occupies when the press load on the web or sheet is released. The elevated gas pressure need only be a fraction of the pressure corresponding to the thermodynamic saturation pressure of the liquid inside the web when the liquid is at a temperature equal to the heated press surface temperature. The pressurizing gas may be air or other suitable gas which does not react in an undesirable manner with the web, vapor or apparatus. The gas may be cooled or serve to cool below ambient temperatures. The details of the apparatus vary to accommodate the press used. However, the apparatus includes: a chamber or the equivalent for containing the pressurized gas, means of introducing the pressurized gas, means of monitoring the pressure of the pressurized gas, means of controlling the pressure of the pressurizing gas, means of venting the pressurizing gas, means of introducing the sheet or web to the press, and means of removing the sheet or web from the pressurized chamber. In the case of a linear press, the chamber may enclose the entire press. In the case of a roll press, the chamber may enclose either the entire press or only the exit area in the region of the press nip. The method inhibits web delamination regardless of press surface thermal diffusivity, web internal structure, web basis weight, or web internal liquid.

DETAILED DESCRIPTION OF THE INVENTION

The present invention is directed to the discovery that web delamination can be eliminated, regardless of press surface thermal diffusivity, web specific surface, web basis weight, or web internal liquid, by providing a region of elevated gas pressure and cooling around the web when the press load on the web is released. Cooling may be effected by using cooled gas or by gas flow or expansion. The only requirement is that the region of elevated gas pressure encompass the region occupied by the web when the press load on the web is released. The magnitude of the gas pressure required to prevent delamination is dependent on the liquid internal to the web, the amount of liquid internal to the web, the web internal structure, the web basis weight, and the thermal diffusivity of the heated press surface. However, it is possible in all cases to exert a gas pressure which inhibits delamination of the web. The elevated gas pressure need only be a fraction of the pressure corresponding to the thermodynamic saturation pressure of the liquid inside the web when the liquid is at a temperature equal to the heated press surface temperature. The purpose is not to inhibit flashing, but rather to control the forces exerted on the web structure by the vapor either resident in the web or generated in the web as the press load is released.

The mechanisms for controlling the vapor generated forces include, but are not limited to, some reduction in the mass of liquid which flashes to vapor, increased cooling of the web or sheet, reduced exhaust velocity of vapor, reduction in vapor induced drag forces, prevention of sonic vapor velocity across constrictions in internal web pores and reduction in static force imbalances. These mechanisms can be enhanced by the use of a pressurized gas which is introduced to the pressure chamber at a temperature below the ambient temperature. A gas which is heated to a temperature above the ambient temperature may also be used, however the gas pressure required to inhibit delamination may need to be increased. The pressurizing gas may be air or another suitable gas which does not react in an undesirable manner with the web, vapor or apparatus.

The apparatus includes: a chamber for containing the pressurizing gas or the equivalent, means of introducing the pressurizing gas, means of monitoring the pressure of the pressurizing gas, means of controlling the pressure of the pressurized gas, means of venting the pressurizing gas, means of introducing the sheet or web to the press, and means of removing the sheet or web from the pressurized chamber.

The chamber for containing the pressurized gas need only maintain the required pressure to inhibit delamination in the immediate vicinity of the web or sheet. The region encompassed by the chamber must include that region occupied by the web or sheet when the press load is released. The chamber may include the entire press. The chamber region must be large enough that the web or sheet is maintained in the pressurized region for a sufficient time to inhibit delamination. This time will vary with web structure, web basis weight, web internal fluid and heated press surface temperature. In the case of a typical paper web containing water this time is less than 2 seconds. The chamber need not incorporate a sealed physical structure. In a particular application it may be sufficient to create the effect of a chamber by use of gas jets to create a pressurized region of the required size. If the chamber uses a physical structure to contain the gas, the chamber may leak gas, provided the pressure in the region of the web is maintained and the leaking gas does not damage the apparatus, web or constitute a safety hazard. The leaking of the gas may cause a cooling effect.

The apparatus must have means of introducing the pressurizing gas to the pressure chamber. The method used for introducing the gas should not result in a jet of gas impacting on the web or sheet surface with sufficient force to cause damage. If the pressure required to inhibit delamination of the web is high enough that such a jet is produced, then the jet must either be oriented so it does not damage the web or sheet or a baffle mechanism must be introduced between the web and the gas jet. The method used for introducing the gas to the chamber should incorporate means of adjusting the flow of gas into the chamber.

The apparatus should include means of monitoring the pressure of the pressurizing gas inside the chamber. The method used is dependent on the application. In a batch type process, a simple industrial type gauge may be sufficient. In a continuous process, a pressure transducer providing a continuous output to a control system may be required. The means employed must only provide an indication of the pressure in the chamber sufficient for controlling that pressure. The accuracy and speed of the measurement is that required to inhibit delamination and for efficient operation of the apparatus. Efficient operation is dependent on the application.

The apparatus comprises a means of venting the pressurized gas. The method used should not cause damage to the web. The method used for venting the gas should incorporate means of controlling the rate at which the gas is vented.

The apparatus has means of introducing the sheet or web to the press. The method employed need only ensure that the pressure within the chamber is maintained when the press load is released. In the case of a roll press, a felt may be used to introduce the web to the press. In the case of a linear press, the web or sheet may be introduced manually or by using a mechanical device.

The apparatus further comprises means of removing the sheet or web from the press and pressure chamber. The method used need only ensure that the web or sheet remains in the pressurized chamber for the time required to inhibit delamination and that in the case of a continuous operation, the chamber pressure is maintained. Effective cooling by the gas is desired. In the case of a roll press, a felt can be used to transport the web or sheet from the press nip through the pressure chamber. The felt also acts as a water receiver. The chamber may have a slot opening through which passes the felt and the web. The opening is sealed in such a way that the web is able to pass through and that any gas leakage is limited to that which can be compensated for by the method employed for introducing gas to the chamber. The seal may incorporate a flexible wiper or pair of rolls which are in contact with the web or sheet. In the case of a linear press, the web or sheet can be removed manually or by using a mechanical device.

In the method of the present invention, the web or sheet is introduced into a heated surface press having opposed surfaces. The heated surface is of a rigid material which can be easily heated, such as steel or steel coated with a material having specific thermal or material properties, i.e., ceramics, polymers, inorganic plastics, composite materials and cermets or any other material with the required strength properties. Thus, the heated surface may have high or low diffusivity. The other surface may either be a rigid material with the strength properties required for the particular press load and application, such as steel, or it may be steel coated with a polymer, or the belt of a shoe press. In one embodiment, a web of a resilient material, such as a felt, is interposed between the unheated surface and the heated surface as the web is introduced to the press. The two press surfaces are urged together to provide a compressive force on the web. In the case of impulse drying of paper, the preferred compressive nip pressure is from about 0.3 MPa to about 10.0 MPa.

The heated surface is heated to provide a surface temperature between the atmospheric boiling temperature of the internal web fluid and the thermodynamic critical point temperature of the internal web fluid. In the case of a paper web containing water, the temperature is from about 100° C. to about 374° C., preferably from about 200° C. to about 300° C.

The residence time in the press is adjusted to provide maximum fluid removal. In the case of a paper web, the residence times can be from about 10 ms to 100 ms, preferably from about 20 ms to about 60 ms. In a roll press or shoe press, the residence time is controlled by the speed of the web and the length of the press nip.

The method of the present invention is useful for drying paper webs having an initial moisture level of from about 75% to about 50%. The moisture content of the paper web after being subjected to impulse drying in accordance with the invention will be in the range of from about 65% to about 30%. All percentages used herein are by weight, unless otherwise specified. The gas pressure required to inhibit delamination depends on the paper furnish, basis weight and press heated surface temperature. In general, the minimum gage pressure required is about 0.00 MPa (0.00 psig) and the maximum gage pressure required is about 0.70 MPa (100 psig) with a heated press surface temperature of 250° C. These pressures may be reduced by employing a cooled gas to pressurize the chamber into which the web is received after the press load is released. The cooled gas will further reduce the mass of liquid which flashes to vapor, increase cooling of the web or sheet, reduce exhaust velocity of vapor, reduce vapor induced drag forces, prevent sonic vapor velocity across constrictions in internal web pores and reduce static force imbalances. The gas may be used to cool through its flow or expansion.

EXAMPLE 1

Laboratory scale pressing simulations were carried out using the apparatus shown in FIG. 1. The apparatus includes a frame 11 on which is mounted a hydraulic cylinder 12. The piston of the hydraulic cylinder 13 actuates a pressure cylinder 14 and heated head 15 through a load cell 16. A heated platen 22 is mounted at the lower extremity of the heating head 15. A thermocouple 23 is mounted between the heating head and the heated platen to measure the temperature of the platen. A pressure piston 17 supports a platen 18 on which rests a felt 19. The pressure piston also supports a ring 20 on which rests a sheet 21 which is to be pressed. A gas inlet 24 is mounted on the upper portion of the pressure cylinder 14. A gas exhaust 25 is mounted on the lower portion of the pressure cylinder. A pressure transducer 26 is located on the lower portion of the pressure cylinder. The pressure piston 17 has a gasket groove 27 and a gasket 28 which provides a dynamic seal when the pressure cylinder 23 and heated platen 22 are moved toward the lower platen 18 to initiate the pressing of the sheet 21. The pressure cylinder 14 and pressure piston 17 have dimensions which insure that a dynamic seal is created before the heated platen 22 contacts the raised ring 20 and sheet 21 assembly. The movement of the pressure cylinder 14, the introduction of gas through the gas inlet 24 and the exhaust of gas through the gas exhaust 25 are controlled by a computer. Gas introduced through the gas inlet 24 is supplied from a tank (not shown). The gas pressure in the tank is equal to the gas pressure required to inhibit delamination of the sheet being pressed.

In operation, a felt 19 is placed on the lower platen 18 and a paper sheet 21 is placed on the raised ring 20. Initially, the gas inlet 24 is closed to inhibit gas from flowing into the pressure cylinder 14 and the gas exhaust 25 is open allowing the interior of the pressure cylinder 14 to vent to the atmosphere. The downward motion of the pressure cylinder 14 is caused by the hydraulic cylinder 12. Prior to the heated platen 22 contacting the raised ring 20 and sheet 21, the gasket 28 creates a dynamic seal between the pressure cylinder 14 and the pressure piston 17, forming a completely closed chamber and allowing the chamber to be pressurized. As the downward motion of the pressure cylinder 14 continues, the pins on the ring 20 contacting the heating head 15 and the ring 20 is pushed downward until the sheet 21 is in contact with the felt 19. Immediately following this contact, the heated platen 22 contacts the sheet 21 and both the sheet 21 and the felt 19 are pressed between the heated upper platen 22 and the lower platen 18. While the pressing is in progress the gas exhaust 25 is closed and the gas inlet 24 is opened, pressurizing the chamber. At the completion of the platen pressing which effects impulse drying, the pressure cylinder 14 is moved upward to an intermediate position. In this position, there is sufficient space for the ring 20 and sheet 21 to return to the original position, separating the sheet 21 from the felt 19. The intermediate position is such that the gasket 28 still forms a seal between the pressure cylinder 14 and the pressure piston 17 and the integrity of the chamber formed by the pressure cylinder 14 and the pressure piston 17 is not affected. This position is maintained for a short period of time, normally less than 2 seconds and preferably less than 10 ms. At the end of that time, the gas exhaust 25 is opened and the gas inlet 24 is closed, venting the chamber to atmosphere. In the process of venting, the expelling gas cools the sheet by forced convection. The pressure cylinder 14 is then raised to the original position allowing the sheet 21 and the felt 19 to be removed.

Figures 2, 3:
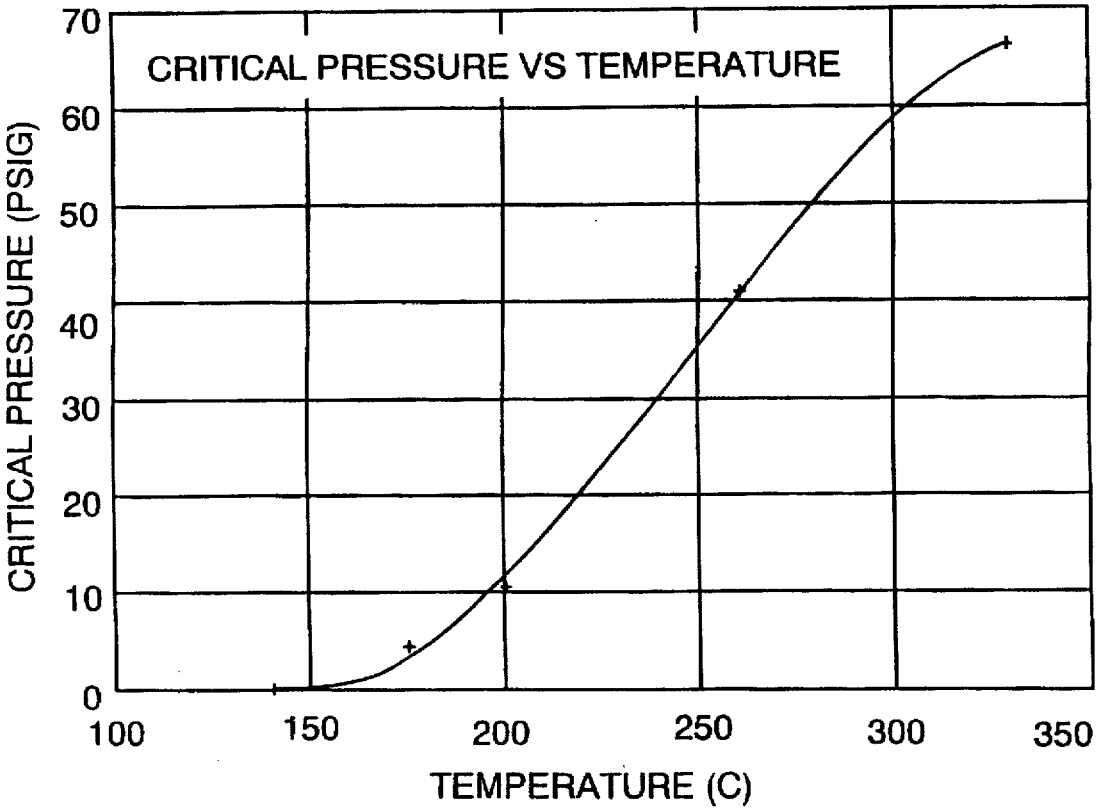
FIG. 2 is a plot of the critical ambient pressures required to inhibit delamination for a particular furnish.
FIG. 3 is a table of the critical ambient pressures required to inhibit delamination for a particular furnish.
Figures 4, 5:
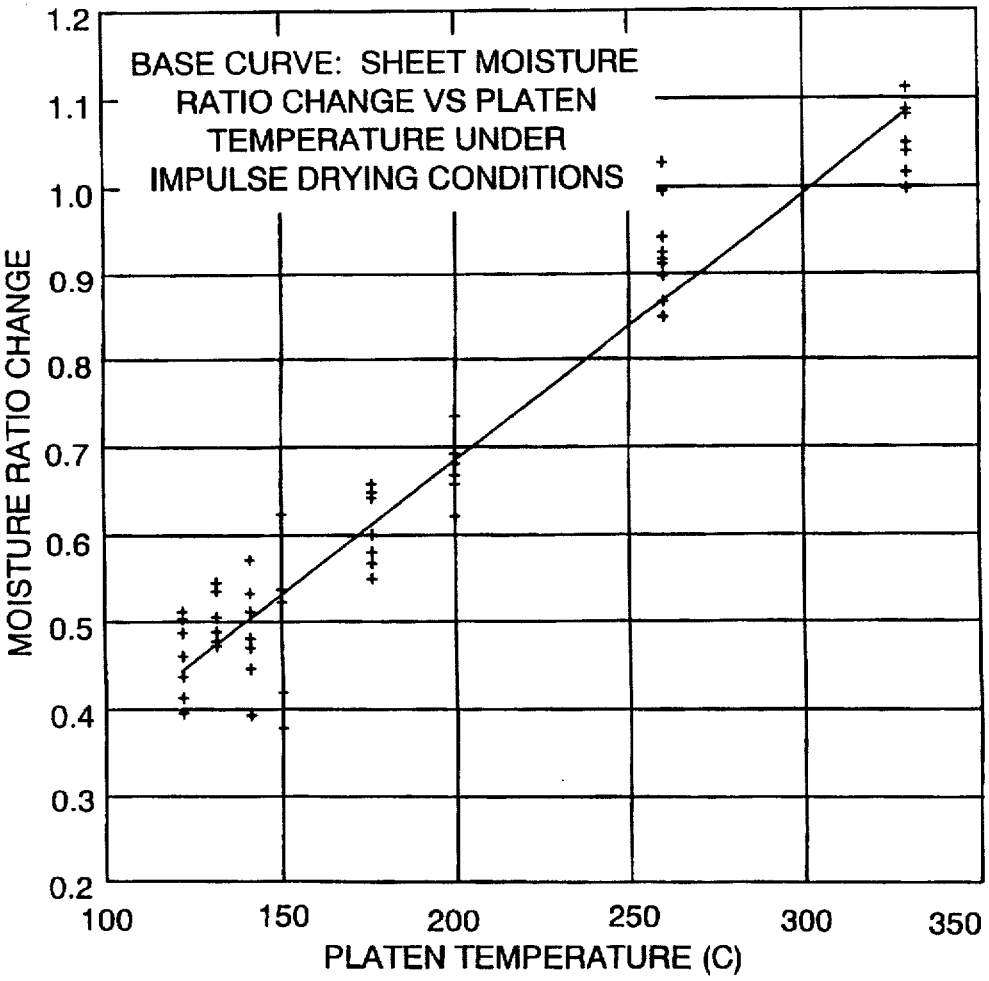
FIG. 4 is a plot of moisture ratio changes for a particular furnish under impulse drying conditions.
FIG. 5 is a table of sheet furnishes and corresponding critical ambient pressures required to inhibit delamination.

Paper hand sheets having 65% moisture, specific surface of 25 $m^2/g$, Canadian Standard Freeness (CSF) of 400 ml, and a basis weight of 204 $g/m^2$ (42 $lb/1000\ ft^2$) were prepared and a series of pressing tests were conducted where the device in FIG. 1 was used to impulse dry the sheets at platen temperatures of 120° C., 130° C., 140° C., 150° C., 175° C., 200° C., 260° C. and 330° C. The pressing residence time was 60 ms and the maximum platen pressure was about 4.24 MPa. At upper platen temperatures of 120° C. and 130° C. and at atmospheric gas pressure there was no delamination of the sheet. At platen temperatures of 140° C. and above there was delamination of the sheet ranging from isolated areas to the complete sheet splitting. At each of the temperatures above 130° C., tests were conducted with increased gas pressures inside the chamber formed by the pressure cylinder 14 and the pressure piston 17. The pressures were increased until the delamination of the sheets was inhibited. FIG. 2 is a graph indicating the minimum pressure, or critical gas pressure, required to inhibit sheet delamination at each of the temperatures above 130° C. The critical gas pressures for these tests are given in tabular form in FIG. 3. FIG. 4 shows a plot of the Moisture Ratio Change ([moisture in the sheet prior to impulse drying minus the moisture in the sheet after impulse drying]/oven dried sheet weight) for the tests performed at atmospheric gas pressure, the straight line nature of this plot is characteristic of impulse drying. The moisture ratio changes for the tests conducted at elevated gas pressure also fell on this curve, indicating that the pressurization of the chamber did not alter the impulse drying process.

An additional set of impulse dryings were conducted. These dryings used a platen temperature of 250° C. and a nip residence time of 40 ms and similar impulse drying to the previous case using 60 ms, and the sheet formations are given in FIG. 5. These formations represent the extremes of basis weights, moisture levels and specific surfaces found in commercial liner board. The pressure was increased in the chamber until there was no visible delamination of the sheets. FIG. 5 also gives the critical pressures for each of the sheet types pressed. A heated platen 22 made from steel was used in all of the tests. The heated platen 22 could have been fabricated from any material with the necessary strength properties.

EXAMPLE 2

Figure 7:
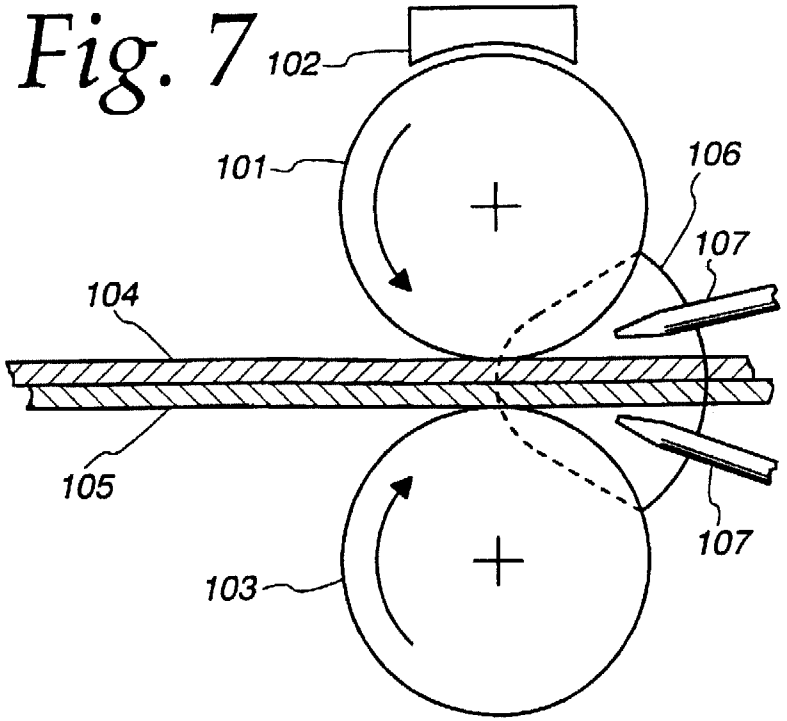
FIG. 7 is a schematic end view of the apparatus shown in FIG. 6 taken along line 7—7.
Figure 6:
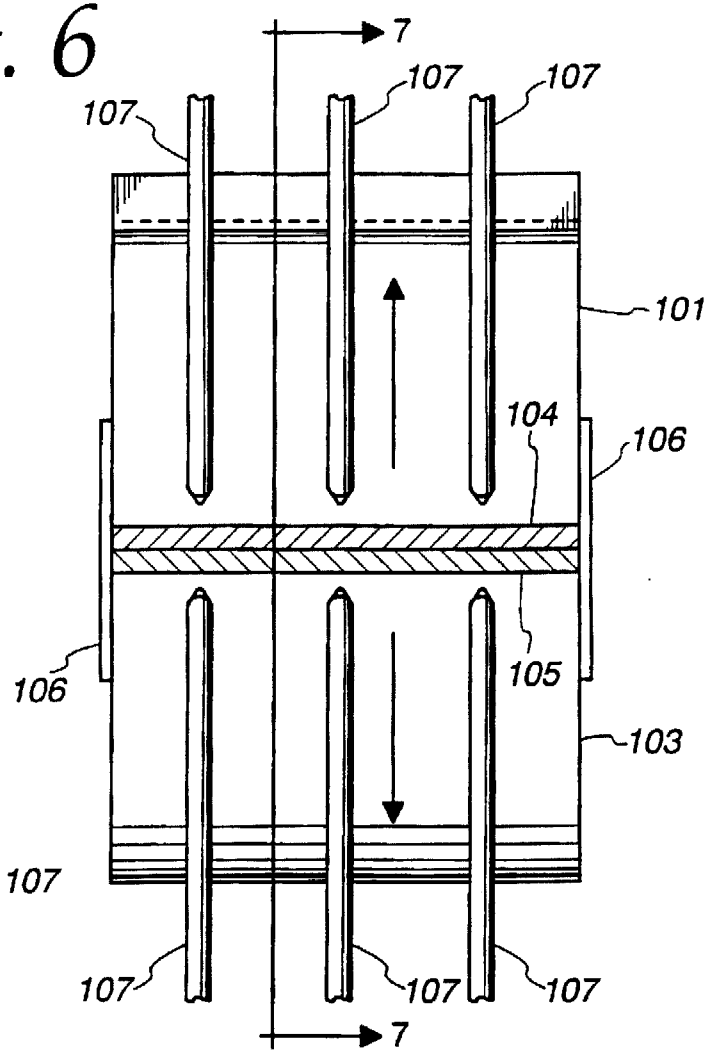
FIG. 6 is a schematic side view of an industrial implementation of the invention.

The method of the present invention can be implemented on an industrial scale as shown in FIGS. 6 and 7. The apparatus in FIGS. 6 and 7 is a roll press. It includes a heated roll 101, a heater 102, a lower unheated roll 103, the web 104 being pressed between the rolls on a felt 105 used for transporting the web 104, a pair of side covers 106 and a number of air knives 107. The heated roll 101 and the lower roll 103 are mounted as in a standard roll press and are used to provide the compressive force on the web 104 and felt 105. The lower roll 103 can be replaced by a shoe press. The air knives 107 are used to direct a flow or gas at the line where the web 104 and heated roll 101 contact cease and at the line where the felt 105 and the roll 103 contact cease. The gas flow through the air knives 107 is of sufficient flow rate and of the appropriate direction to produce a high pressure region at the roll nip opening which provides an equivalent pressure chamber. The air knives 107 are of sufficient number to produce a uniform high pressure region across the entire face of the heated roll 101 and the lower roll 103. The gas used in the air knives 107 can be air or any other gas which does not react with the web 104, felt 105 or apparatus, or create a hazard for the personnel operating the apparatus. A gas cooled below ambient temperatures may be used. Use of a cooled gas may reduce the pressure required to inhibit delamination of the web 104. Further, the flow of gas may be out of the region the nip can effectively cool. The side covers 106 serve to limit the flow of gas across the face of the rolls, web 104 and felt 105 but can be adjusted to allow sufficient flow to cool. The air knives 106 directing the gas flow towards the felt 105 can be replaced by a rigid platform which would be positioned directly underneath the felt 105 and would support both the felt 105 and the web 104. A pressure probe can be inserted into the region immediately adjacent to the nip opening for the purpose of measuring the pressure generated by the gas flow from the air knives 107.

The rotation direction of the heated roll 101 and the lower roll 103 are indicated by arrows in FIG. 7. The roll rotation serves to propel the felt 105 and the web 104 between the two rolls. The heated roll can be constructed of steel, steel coated with a low thermal diffusivity material such as ceramic, or from any other material with the required strength properties. The thermal characteristics of the heated roll may affect the gas pressure required to inhibit delamination.

EXAMPLE 3

Figure 9:
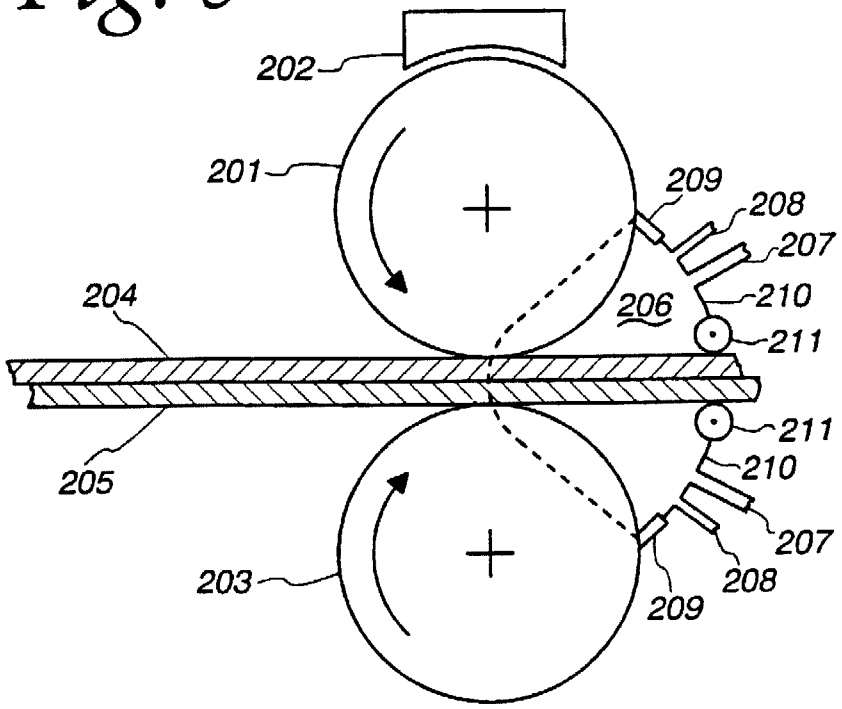
FIG. 9 is a schematic end view of the apparatus shown in FIG. 8 taken along line 9—9.
Figure 8:
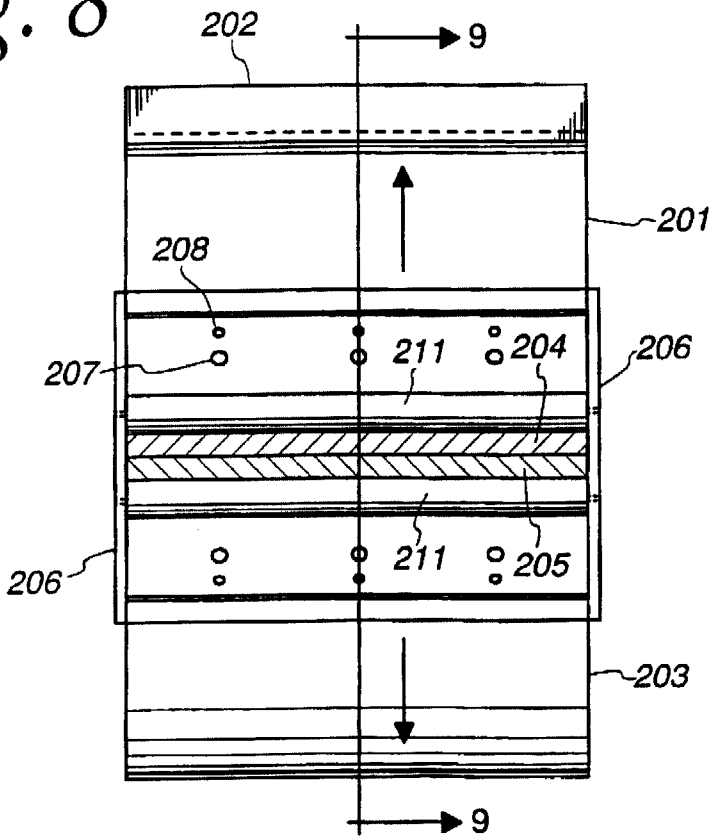
FIG. 8 is a schematic side view of another industrial implementation of the invention.

The method of the present invention can be implemented on an industrial scale as shown in FIGS. 8 and 9. The apparatus in FIGS. 8 and 9 is a roll press. It includes a heated roll 201, a heater 202, a lower unheated roll 203, the web 204 being pressed, a felt 205 for transporting the web 204, a pair of side covers 206 and a number of gas inlets 207, a number of gas exhausts 208, a chamber cover 210, flexible seals 209 and rollers 211. The flexible seals provide a gas seal between the chamber cover 210 and the heated roll 201 and between the chamber cover 210 and the lower roll 203. The rollers 211 provide a gas seal between the chamber cover 210 and the web 204 and between the chamber cover 210 and the felt 205. The heated roll 201 and the lower roll 203 are mounted as in a standard roll press and are used to provide the compressive force on the web 204 and felt 205. The lower roll 203 can be replaced by a shoe press. The gas inlets 207 are used to introduce gas into the chamber formed by the chamber cover 210, the heated roll 201, the lower roll 203 and the side covers 206. Introducing gas into the chamber causes the chamber to pressurize and thus inhibit delamination of the web. The gas exhausts 208 can be used to depressurize the chamber and to control the pressure level inside the chamber as well as gas flow through the chamber. The gas inlets 207 can also be used to control the chamber pressure. The gas flow introduced through the gas inlets 207 needs to be of a direction and volume flow rate that does not damage the web 204 yet produces the desired pressure within the chamber. If the required volume flow rate is high enough that the web 204 may be damaged then a baffle (not shown) should be introduced between the gas inlet 207 and the web 204. The gas used to pressurize the chamber can be air or any other gas which does not react with the web 204, felt 205 or apparatus or create a hazard for the personnel operating the apparatus. A gas cooled below ambient temperatures may be used. Use of a cooled gas may reduce the pressure required to inhibit delamination of the web 204. The chamber portion beneath the felt 205 can be replaced by a rigid platform (not shown) which would be positioned directly beneath the felt 205, and would support both the felt 205 and the web 204. A second chamber cover 210 can be added downstream from the first chamber cover 210. In this arrangement, the region covered by the first chamber cover 210 would be at a pressure P1 and the region between the second chamber cover 210 and the first chamber cover 210 would be at pressure P2, where P1>P2. A pressure probe is inserted into each chamber for the purpose of measuring the pressure within the chamber.

The rotation direction of the heated roll 201 and the lower roll 203 are indicated by arrows in FIG. 9. The roll rotation serves to propel the felt 205 and the web 204 between the two rolls. The heated roll may be constructed of steel, steel coated with a low thermal diffusivity material such as ceramic, or from any other material with the required strength properties. The thermal characteristics of the heated roll may affect the gas pressure required to inhibit delamination.

EXAMPLE 4

Figure 11:
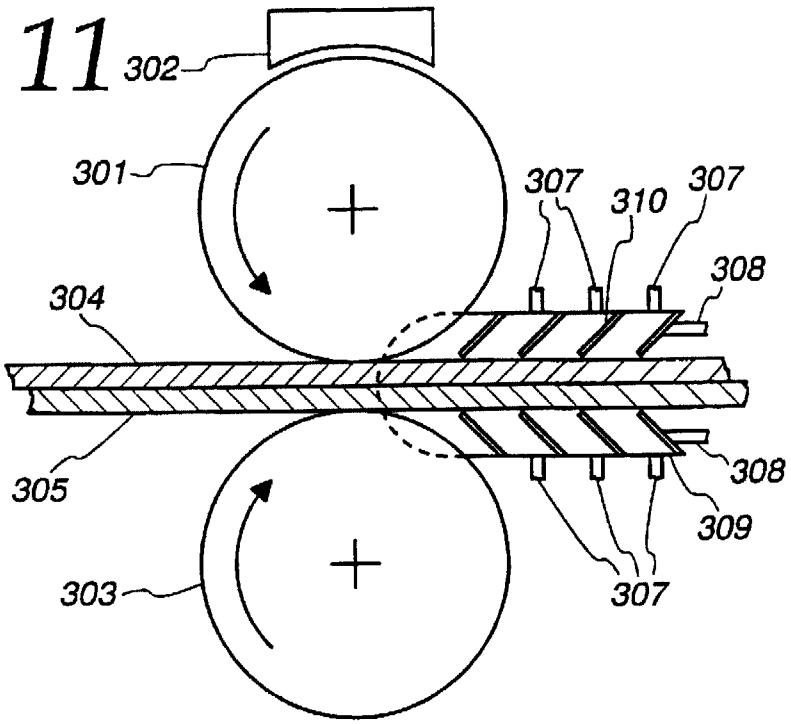
FIG. 11 is a schematic end view of the apparatus shown in FIG. 10 taken along line 11—11.
Figure 10:
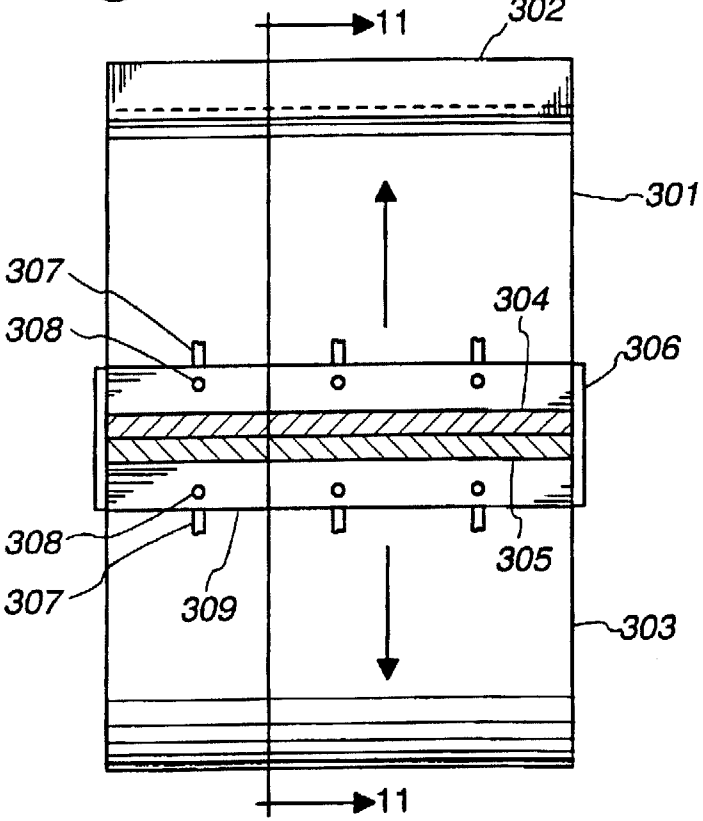
FIG. 10 is a schematic side view of a further industrial implementation of the invention.

The method of the present invention can be implemented on an industrial scale as shown in FIGS. 10 and 11. The apparatus in FIGS. 10 and 11 is a roll press. It includes a heated roll 301, a heater 302, a lower unheated roll 303, the web 304 being pressed, a felt 305 for transporting the web 304, a pair of side covers 306, a number of gas inlets 307, a number of gas exhausts 308 and a foil assembly 309. The heated roll 301 and the lower roll 303 are mounted as in a standard roll press and are used to provide the compressive force on the web 304 and felt 305. The lower roll 303 can be replaced by a shoe press. The foil assembly 309 consists of multiple foils 310 which create small closed chambers between successive foils 310 and the web 304 or the felt 305. The sides of the foil assembly 309 are sealed by side covers 306. The chamber formed by the foils 310 which is closest to the heated roll 301 and the chamber formed by the foils 310 which is closest to the lower roll 303 are at the highest pressure. Moving downstream from the rolls, the pressure in each succeeding chamber is less than that in the preceding chamber. In this way, the web 304 is subjected to a series of pressure steps which decrease the pressure as the web moves away from the rolls. The gas inlets 307 are used to introduce gas into each chamber formed by the foils 310 and the web 304 or felt 305. Introducing gas into the chambers causes the chamber to pressurize and thus inhibit delamination of the web. The gas exhaust 308 can be used to depressurize the chamber and to control the pressure level inside the chamber. The gas will tend to flow from the high pressure chambers to the low pressure chambers and out of the gas exhaust 308. The gas inlets 307 can also be used to control the chamber pressure. The gas flow introduced through the gas inlets 307 needs to be of a direction and volume flow rate that does not damage the web 304 yet produces the desired pressure within the chamber. If the required volume flow rate is high enough that the web 304 may be damaged then a baffle should be introduced between the gas inlet 307 and the web 304. The gas used to pressurize the chamber can be air or any other gas which does not react with the web 304 or felt 305, or apparatus or create a hazard for the personnel operating the apparatus. A gas cooled below ambient temperatures may be used. Use of a cooled gas may reduce the pressure required to inhibit delamination of the web 304. The chamber portion beneath the felt 305 can be replaced by a rigid platform (not shown) which would be positioned directly beneath the felt 305, and would support both the felt 305 and the web 304. A pressure probe (not shown) should be inserted into each of the chambers formed by the foils 310.

The rotation direction of the heated roll 301 and the lower roll 303 are indicated by arrows in FIG. 11. The roll rotation services to propel the felt 305 and the web 304 between the two rolls. The heated roll may be constructed of steel, steel coated with a low thermal diffusivity material such as ceramic, or from any other material with the required strength properties. The thermal characteristics of the heated roll will affect the gas pressure required to inhibit delamination.

Various aspects of the invention have been described with particularity; however, numerous variations and modifications will be readily apparent to one skilled in the art.

What is claimed is:

1. Apparatus for drying a fiber web having a pair of opposed surfaces comprising, in combination:

a first roller having an outer heat transfer surface and means for heating the outer heat transfer surface above ambient temperature;

a second, unheated roller having an outer surface;

said first and said second rollers cooperating to form a nip therebetween, the first and the second rollers together comprising a pressing means for pressing said web;

a felt web passing through the nip in contact with the second roller for supporting said fiber web as it passes through the nip in contact with the first roller so as to be pressed by the first and the second rollers while being advanced in a downstream direction;

a gas pressure chamber downstream of said nip;

means for introducing pressurized gas into said pressure chamber with said pressure chamber confining the pressurized gas so as to apply a pressure to both surfaces of said fiber web as pressure on said fiber web from said first and said second rollers is released;

means for controlling gas pressure in said pressure chamber; and means for venting gas from said gas pressure chamber.

2. Apparatus for drying a fiber web in accordance with claim 1 wherein said means for introducing pressurized gas comprises a plurality of air knives.

3. Apparatus for drying a fiber web having a pair of opposed surfaces comprising, in combination:

a shoe press including first and second opposed platens, the first and the second platens each having active surfaces, with the first platen including heating means for heating the active surface of the first platen;

means for moving the first and the second platens toward and away from each other for pressing and releasing the fiber web, respectively;

first and second gas pressure chamber components associated with the first and the second platens, respectively, and cooperating with one another when said first and said second platens are moved together to form a gas pressure chamber surrounding said pressing means;

means for introducing pressurized gas into said pressure chamber with said pressure chamber confining the pressurized gas so as to apply a pressure to the surfaces of said fiber web as pressure on the web from said first and said second platens is released;

means for controlling gas pressure in said pressure chamber; and means for venting gas from said gas pressure chamber.

4. Apparatus for drying a fiber web in accordance with claim 1 wherein said gas pressure chamber encloses said pressing means.

* * * * *

UNITED STATES PATENT AND TRADEMARK OFFICE

CERTIFICATE OF CORRECTION

PATENT NO. : 5,722,183
DATED : March 3, 1998
INVENTOR(S) : David I. Orloff et al.

It is certified that error appears in the above-identified patent and that said Letters Patent is hereby corrected as shown below:

Column 1,
Line 6, above the caption "Field of the Invention" insert the following:

-- Governmental Rights

This invention was made with Government support under Contract No. DE-FG02-85CE40738 awarded by the Department of Energy. The government has certain rights in this invention. --

Signed and Sealed this

Twenty-fifth Day of December, 2001

*Attest:*

*Attesting Officer*

JAMES E. ROGAN
*Director of the United States Patent and Trademark Office*